US005186427A

United States Patent [19]

Semchuck

[11] Patent Number: 5,186,427

[45] Date of Patent: Feb. 16, 1993

[54] ACCESSORIES AND MOUNTING ASSEMBLIES THEREFOR

[75] Inventor: Mario E. Semchuck, Chatsworth, Calif.

[73] Assignee: Emhart Inc., Newark, Del.

[21] Appl. No.: 853,843

[22] Filed: Mar. 19, 1992

Related U.S. Application Data

[63] Continuation of Ser. No. 510,507, Apr. 19, 1990, abandoned.

[51] Int. Cl.[5] ..... A47G 29/00

[52] U.S. Cl. ..... 248/251; 248/224.3

[58] Field of Search ..... 248/251, 224.3, 222.1

[56] References Cited

U.S. PATENT DOCUMENTS 2,542,941 2/1951 Post ..... 248/251 X

*Primary Examiner*—Alvin C. Chin-Shue

*Attorney, Agent, or Firm*—J. Bruce Hoofnagle

[57] ABSTRACT

An accessory such as, for example, a towel bar (30) includes a pair of spaced supports (54) and (56) which are mounted to a wall (58) and support therebetween a bar (60) for supporting a towel (not shown). Each of the support (54) and (56) include a flange (62), a sleeve or hub (64), a decorator ring (66) and an end-cover button (68). An insert (114) is positioned within a hole (106) formed in the side of sleeve (64) to facilitate support of bar (60) within the spaced sleeves.

Each of the supports (54) and (56) is mounted over and attached to a post (78) which is attached to and extends from a base (76) whereby the post and base form a wall mount (74). The wall mount (74) is attached to wall (58) to support the towel bar (30) with the bar (60) being positioned for utilization relative to the external support.

Other accessories such as a shelf (32), a soap dish (34), a tumbler/toothbrush holder (36), a shelf assembly (38), a robe hook (46), a towel ring (48), a soap dish stand (50) and a toilet paper holder (52) utilize similar supports and mounting facilities as those of towel bar (30).

20 Claims, 12 Drawing Sheets

ACCESSORIES AND MOUNTING ASSEMBLIES THEREFOR

This is a continuation of application Ser. No. 510,507, filed Apr. 19, 1990, now abandoned.

BACKGROUND OF THE INVENTION

This invention relates to accessories and mounting assemblies therefor and particularly relates to accessories for use in a room such as, for example, a bathroom and to the structures of various assemblies used to mount or support the accessories.

In various rooms of a house, accessories are added to the rooms to provide ready access to facilities which are unique to the particular rooms. For example, in the kitchen, there are many different accessories the availability of which enhances the utility of the kitchen. Such accessories include, but are not limited to wall mounted knife holders, under-the-counter appliances, timer clocks, can openers, knife sharpeners and many more accessories common to kitchen-oriented activities.

In the bathroom, such accessories could include, but are not limited to, wall-mounted shelves, wall-mounted soap dishes, wall-mounted tumbler/toothbrush holders, a combination of the of the three above-mentioned accessories, towel bars, robe hooks, towel rings, soap dish stands and toilet paper holders The mounting of so many different accessories could present a tedious and time-consuming task, particularly when each accessory is mounted in a manner different from the other accessories. Therefore, there is a need for a mounting assembly which complements the structure of the accessory to facilitate ready and easy assembly and installation of the accessory in position for use. Further, there is a need for accessories which have a common theme in structure to further enhance the assembly and installation process.

SUMMARY OF THE INVENTION

It is an object of this invention to provide a mounting assembly for locating an accessory element relative to an external support for utility purposes.

Another object of this invention is to provide an accessory which includes an accessory element supported by a mounting assembly to locate the accessory element in position for utilization relative to an external support.

With these and other objects in mind, this invention contemplates a mounting assembly for an accessory including means for supporting an accessory element in position for utility. Means are provided for facilitating attachment of the accessory element to the supporting means. A mounting means locates the supporting means and the accessory element relative to an external support. Means are provided for attaching the supporting means to the mounting means so that the accessory element is positioned for utilization relative to the external support.

This invention further contemplates an accessory for supporting an object for utility purposes and includes an accessory element for supporting the object. Means are provided for supporting the accessory element in position for utility. Additional means facilitate attachment of the accessory element to the supporting means. A mounting means locates the supporting means and the accessory element relative to an external support. Means are provided for attaching the supporting means to the mounting means so that the accessory element is positioned for supporting the object relative to the external support.

Other objects, advantages and novel aspects of this invention will become apparent upon review of the following detailed description, taken in conjunction with the following illustrations.

DETAILED DESCRIPTION OF THE PREFERRED EMBODIMENTS

Figure 7:
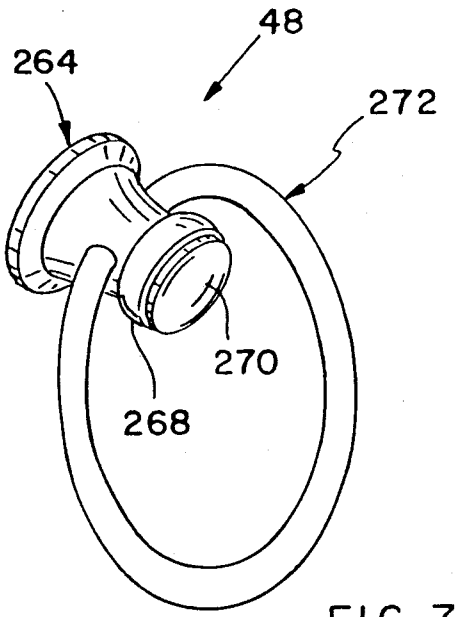
FIG. 7 is a perspective view of a towel ring embodying certain principles of the invention.
Figure 8:
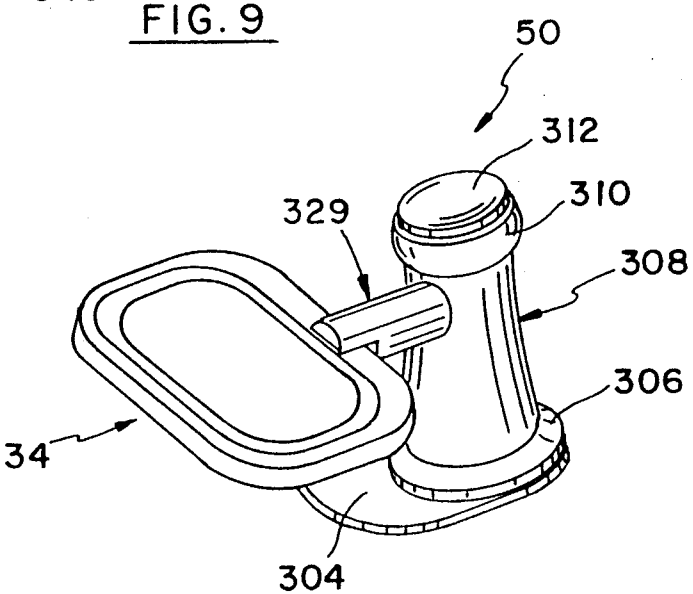
FIG. 8 is a perspective view of a soap dish stand embodying certain principles of the invention.
Figure 9:
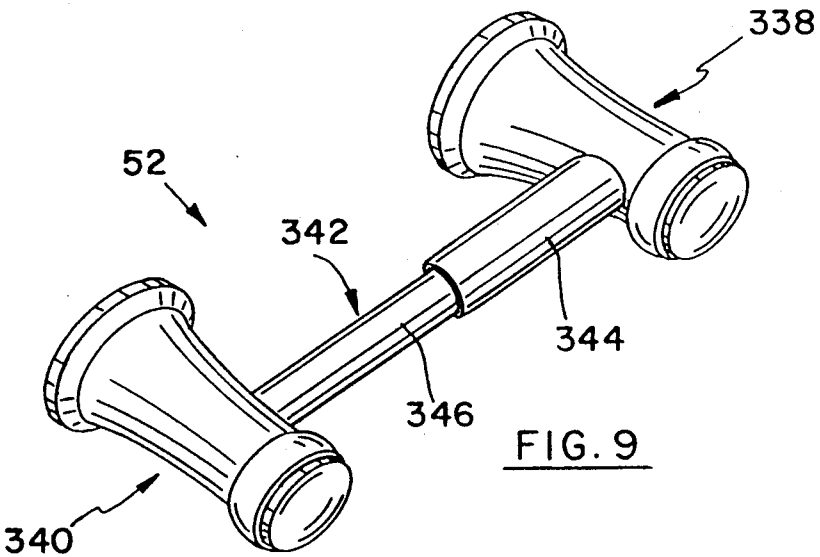
FIG. 9 is a perspective view of a toilet paper holder embodying certain principles of the invention.

Referring to FIGS. 1 through 9, there is illustrated a plurality of bathroom accessories which include a towel bar 30 (FIG. 1); and a shelf 32 (FIG. 2); a soap dish 34 (FIG. 3); a tumbler/toothbrush holder 36 (FIG. 4); a shelf assembly 38 (FIG. 5) which includes a shelf 40, a soap dish 42 and a tumbler/toothbrush holder 44; a robe hook 46 (FIG. 6); a towel ring 48 (FIG. 7); a soap dish stand 50 (FIG. 8) and a toilet paper holder 52 (FIG. 9).

Figure 1:
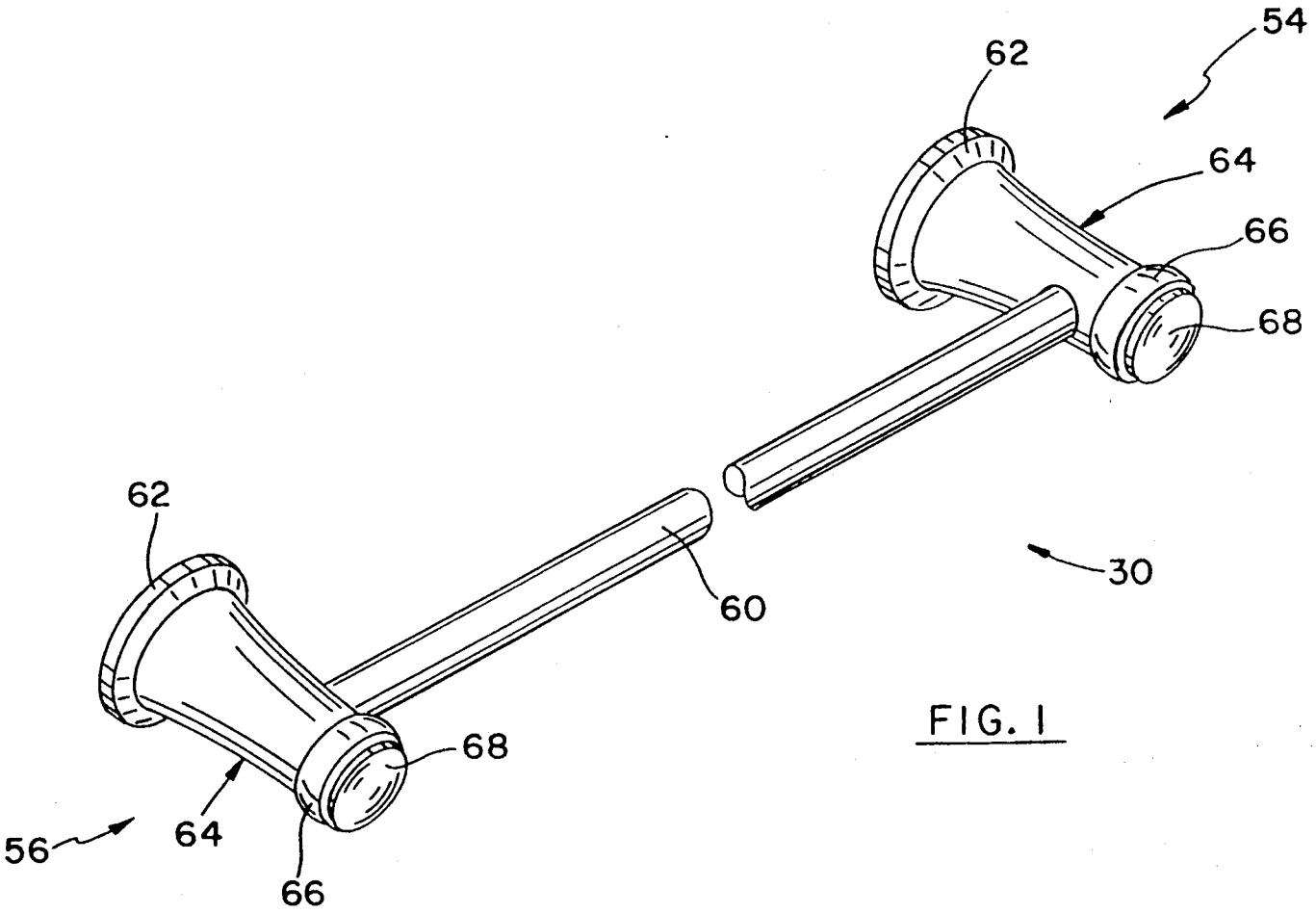
FIG. 1 is a perspective view of a towel bar embodying certain principles of this invention.

As illustrated in FIG. 1, the towel bar 30 includes a pair of spaced supports 54 and 56 which are mounted to a wall 58 (partially shown) and extend therefrom. An accessory element such as a bar 60 is attached at opposite ends thereof to the supports 54 and 56 and provide support for towels (not shown). Supports 54 and 56 thereby provide a means for supporting bar 60 in position for utility. Each of the supports 54 and 56 includes a flange 62, which is adjacent wall 58, and further includes a sleeve or hub 64, a decorator ring 66 and an end-cover button 68.

Figure 10:
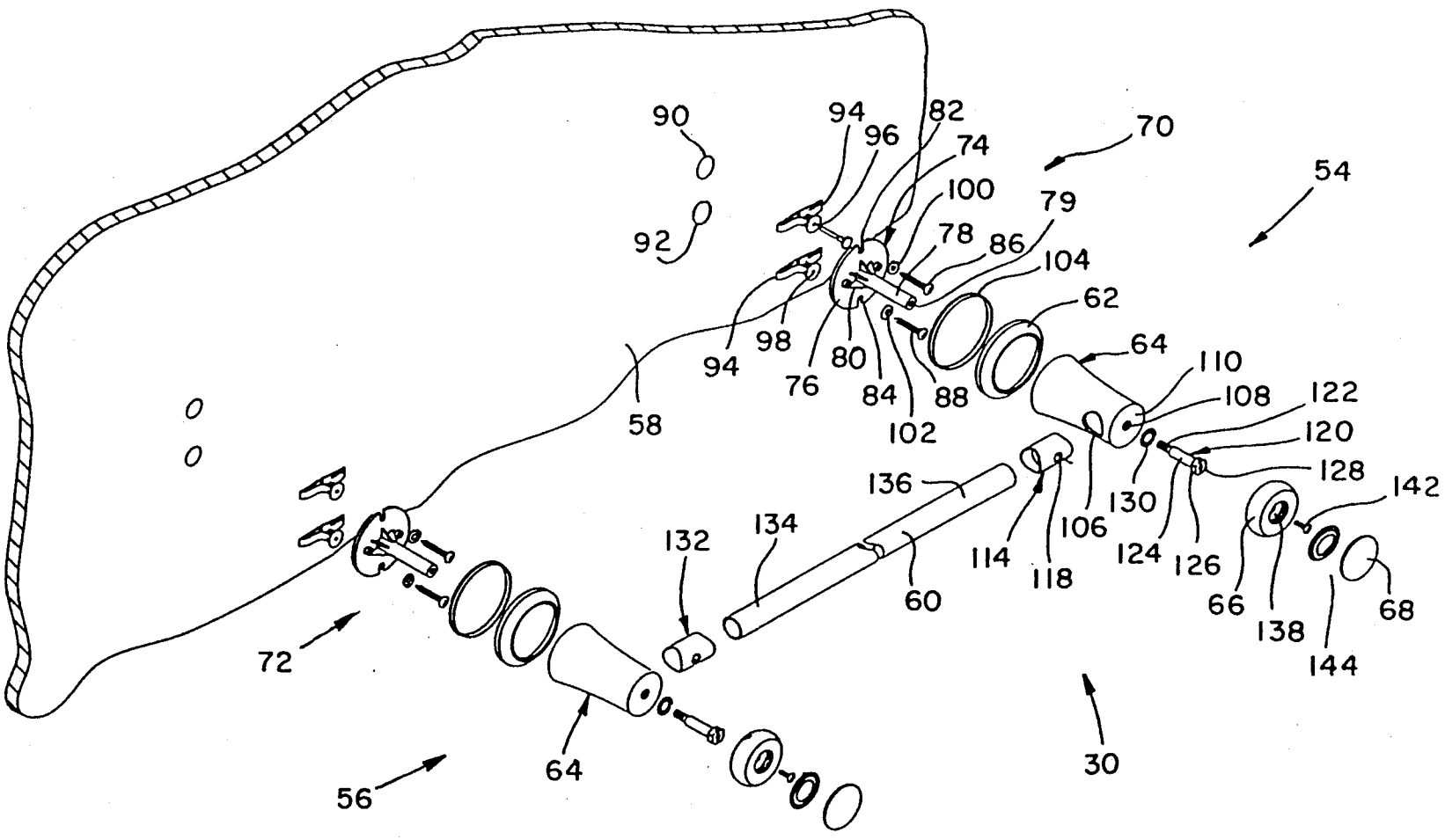
FIG. 10 is a perspective exploded view of a mounting assembly for a towel bar of FIG. 1 and embodies certain principles of the invention.

Referring to FIG. 10, there is illustrated a pair of mounting assemblies 70 and 72 the structure of which complements the structure of the supports 54 and 56 to facilitate easy attachment of towel bar 30 to wall 58. Since wall mounts 70 and 72 are essentially identical, only wall mount 70 will be described in detail it being understood that wall mount 72 is structured and assembled in the same manner. The mounting assembly includes a wall mount 74 having a base 76 and a post 78 extending axially outwardly therefrom with a threaded aperture 79 formed axially in the outward end thereof. A plurality of braces 80 are located on the inward end of the periphery of post 78 and rest against base 76 to provide steady support for the post in its axial alignment with the base. A pair of diametrically opposed slots 82 and 84 are formed in the periphery of base 76 are are positioned to receive therethrough a pair of screws 86 and 88 respectively.

In attaching wall mount 74 to wall 58, a pair of holes 90 and 92 are drilled or formed in the wall. A pair of wall-anchored threaded receptors, such as togglers 94, are mounted in the wall holes 90 and 92 with threaded holes 96 and 98, respectively, of the togglers 94 being axially located with the wall holes and flush with wall 58. The base 76 of wall mount 74 is positioned so that slots 82 and 84 are aligned with threaded holes 96 and 98, respectively. Screw 86 is positioned through a washer 102, slot 84 and is threadedly secured with threaded hole 98. In this manner, wall mount 74 is securely attached to wall 58. Thereafter, a plastic ring gasket 104 and flange 62 are positioned over post 78 whereby the ring gasket engages wall 58 to prevent marring of the surface thereof. Sleeve 64, which is formed with an aperture 106 in the side wall thereof and an axial through hole 108 in a covered end 110 thereof is positioned over post 78 with a flared end 112 being inserted into flange 62. An insert 114 is formed with receptacle opening such as a cup-like opening 116 at an end thereof and a transaxial through-hole 118 through the center thereof. Insert 114 is placed in aperture 106 of sleeve 64 and positioned so that hole 108 of the sleeve and through-hole 118 of the insert are aligned.

A stem 120 is formed with a threaded portion 122 at one end thereof, an intermediate unthreaded shank 124 and an enlarged head 126 at the other end thereof. Enlarged head 126 has flat surfaces on at least opposite sides thereof to facilitate threaded securance of stem 120 in place and is formed axially with a threaded aperture 128 in the outward end thereof. The threaded end of stem 120 is positioned through a star washer 130, sleeve hold 108, through-hold 118 of insert 114 and is threadedly located within threaded aperture 79 of post 78 but is not tightened at this time. It is noted that unthreaded shank 124 of stem 120 is located within through-hole 118 of insert 114.

A cup-shaped opening (not shown) of a second insert 132, which is essentially identical to insert 114, is positioned over a first end 134 of bar 60. Insert 132 is then inserted into aperture 106 (not shown) of sleeve 64 of support 56. A second end 136 of bar 60 is positioned within cup-like opening 116 of insert 114 of support 54. Stem 120 and washer 130 of support 65 are then assembled in the same manner as described above with respect to support 54 but is not tightened. Bar 60 is then examined to insure that the bar is level. If bar 60 is level, stems 120 of both supports 54 and 56 are then tightened.

Thus, inserts 114 and 132 each function as a means for facilitating attachment of the bar 60 to the supporting means formed by support 54 and 56.

Decorator ring 66 is formed with an axial through-hole 138 and a threaded bore 140 of larger diameter at an outward end thereof. Ring 66 is positioned against covered end 110 of sleeve 64 of support 54. A screw 142 is positioned through through-hole 138 and is threadedly secured within threaded aperture 128 of stem 120 to secure ring 66 with the assembly. A rubber-like washer 144 is positioned within a recess (not shown) in the inward side of button 68 and about a threaded hub 146 which extends inwardly of the button. The threaded hub 146 is then positioned within the threaded bore 138 within ring 66 to secure button 68 with the ring to complete the assembly of the components of support 54. The same process is followed to assemble ring 66 and button 68 to support 56 to complete the assembly of the components of towel bar 30.

Thus, mounting assemblies 70 and 72, each of which includes base 76 and post 78 of wall mount 74, forms a mounting means for locating the supporting means and the accessory element relative to an external support such as wall 58.

Figure 2:
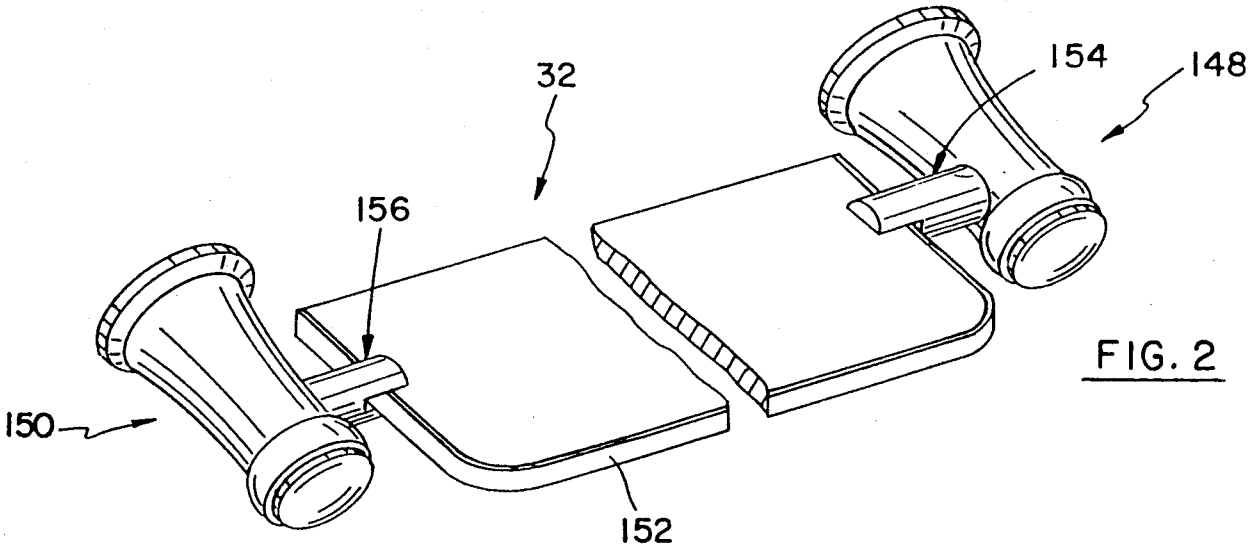
FIG. 2 is a perspective view of a shelf embodying certain principles of the invention.

Referring to FIG. 2, shelf 32 includes spaced apart supports 148 and 150 which are essentially identical to supports 54 and 56 and will not be described further except to describe the manner in which the common components relate to shelf 32.

Figure 11:
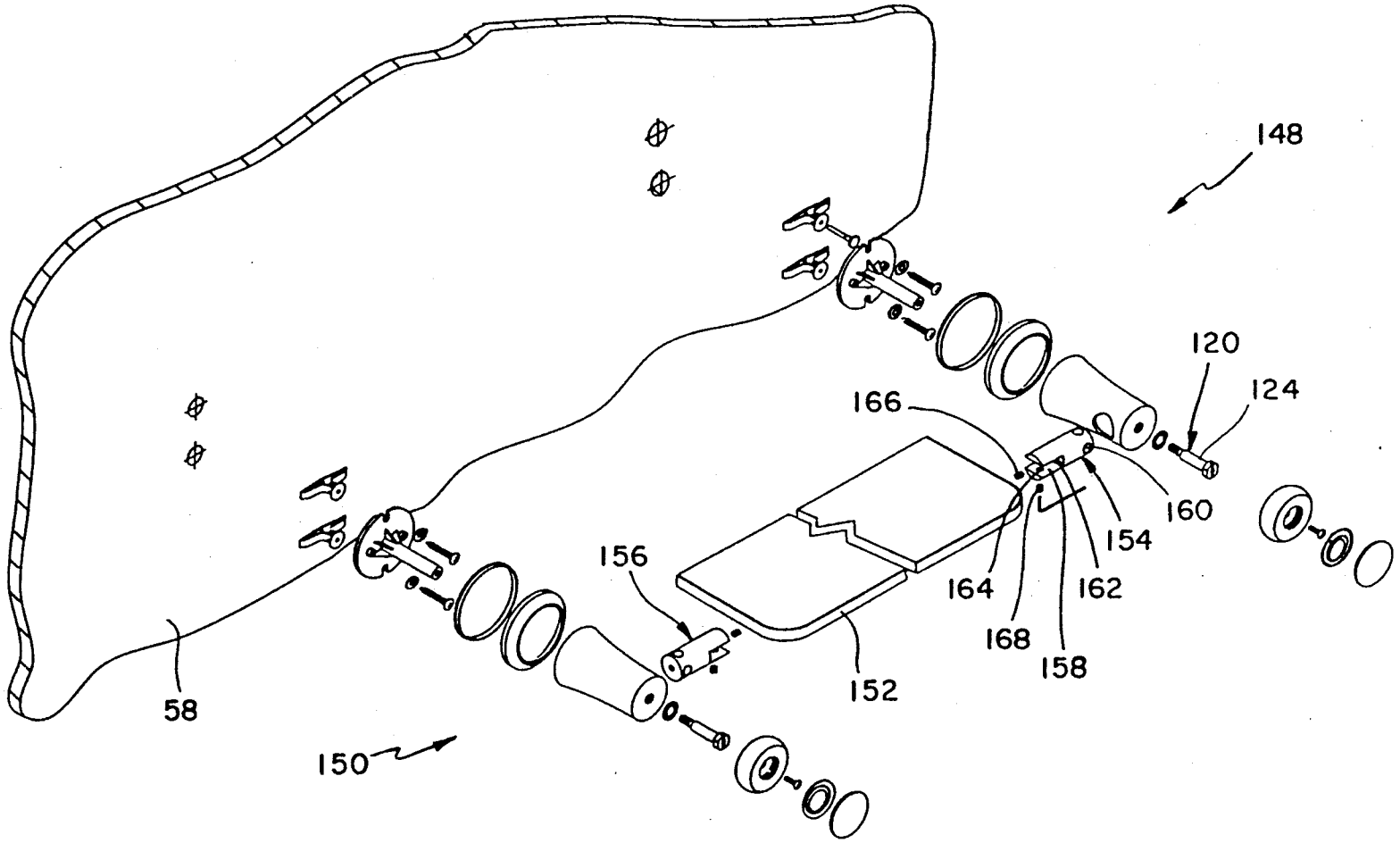
FIG. 11 is a perspective exploded view of a mounting assembly for the shelf of FIG. 2 and embodying certain principles of the invention.

In addition to the components which form towel bar 30 and are common to shelf 32, the shelf includes an accessory element such as shelf element 152 and a pair of identical inserts 154 and 156. As shown in FIG. 11, insert 154 is formed with a receptacle opening such as a slot 158 in one end thereof. A transaxis through-hole 160 is formed through insert 154. A threaded hole 160 is formed axially in the base of slot 158 and communicates with through-hole 160. Also, a threaded hole 164 is formed from the periphery of insert 154 and communicates with slot 158. Insert 154 is assembled in the same manner as insert 114 of towel bar 30 with slot 158 facing toward support 150.

A set screw 166 with a nylon tip is threadedly located within hole 162 and is threadedly positioned so that the nylon tip engage shank 124 of stem 120 to secure insert with support 148. Shelf element 152 is positioned within the spaced slots 158 and is examined to determine whether the shelf element is level. If it isn't, shelf element 152 is removed, set screws 166 are loosened and inserts 154 are rotated slightly. Such slight rotation is available because the diameter of through-holes 160 is slightly larger than the diameter of shank 124 of stem 120. After determining that shelf element 152 is level, a set screw 168 with a nylon tip is threaded moved through hole 164 to urge the nylon tip into engagement with the shelf element to secure the shelf element with insert 154. An identical process is followed with respect to insert 156 to secure shelf element 152 thereto. The remaining components of shelf 32 are assembled in the same manner as in the assembly of towel bar 30.

Figure 4:
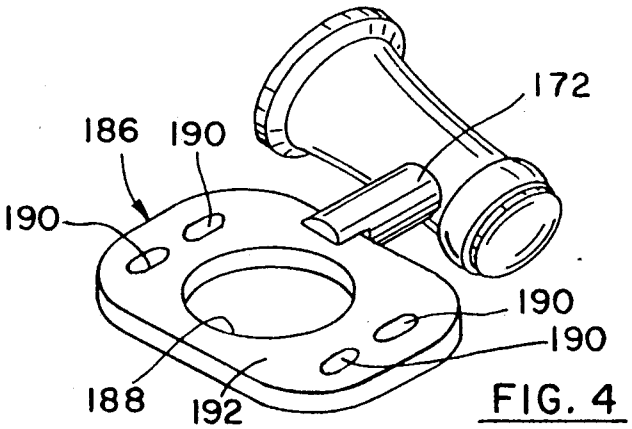
FIG. 4 is a perspective view of a tumbler/toothbrush holder employing certain principles of the invention.
Figure 3:
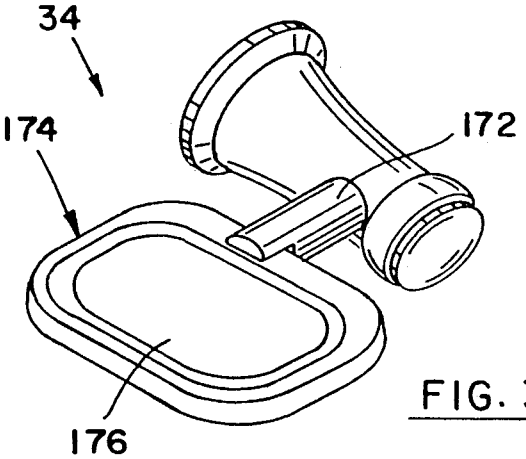
FIG. 3 is a perspective view of a wall-mounted soap dish embodying certain principles of the invention.
Figure 12:
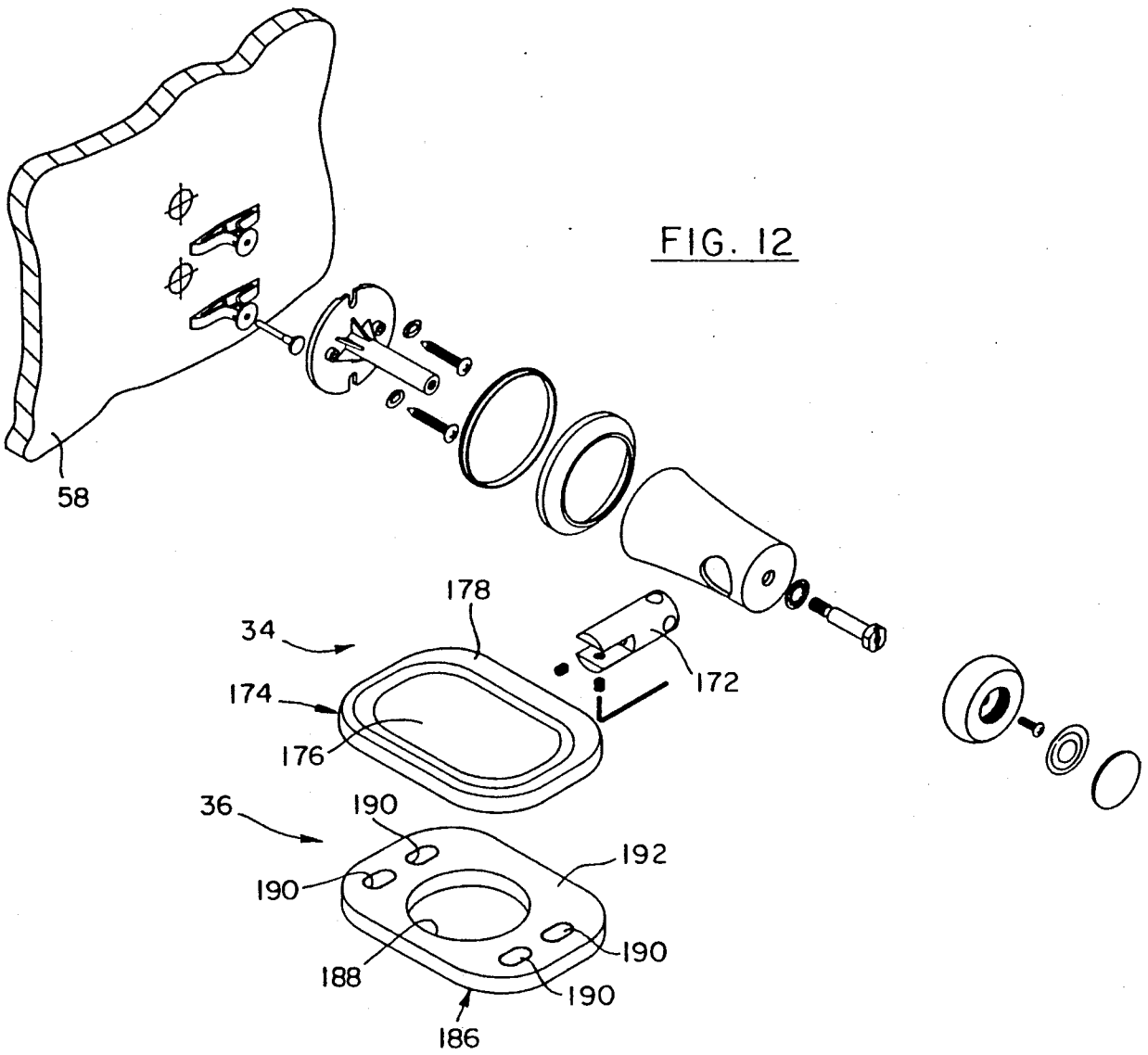
FIG. 12 is a perspective exploded view of a portion of a mounting assembly for the wall-mounted soap dish of FIG. 3 and also for the tumbler/toothbrush holder of FIG. 4 all embodying certain principles of the invention.

Referring to FIG. 3, soap dish 34 includes a single support 170 which is identical to supports 54 and 56 of towel bar 30 and supports 148 and shelf 150 of shelf 32. An accessory element such as soap dish element 174 is formed with a depression 176 which serves as tray for a bar of soap (not shown). As shown in FIG. 12, element 174 is formed with a ledge 178 which is assembled and secured within slot 180 of insert 172 in the same manner as shelf element 152 is assembled and secured within slots 158 and inserts 154 and 156 and is supported thereby in cantilever fashion 111. Referring to FIG. 4, tumbler/toothbrush holder 36 includes a single support 182 and insert 184 which is identical to support 170 and insert 172, respectively, of soap dish 34. Holder 36 includes an accessory element such as a support tray 186 having a tapered-wall hole 188 for supporting a tumbler (not shown) and four holes 190 for supporting toothbrushes (not shown). Referring to FIG. 12, tray 186 is formed with a ledge 192 which is assembled within the slot of insert 172 in the same manner as ledge 178 of soap dish element 174 is assembled.

Figures 5, 6:
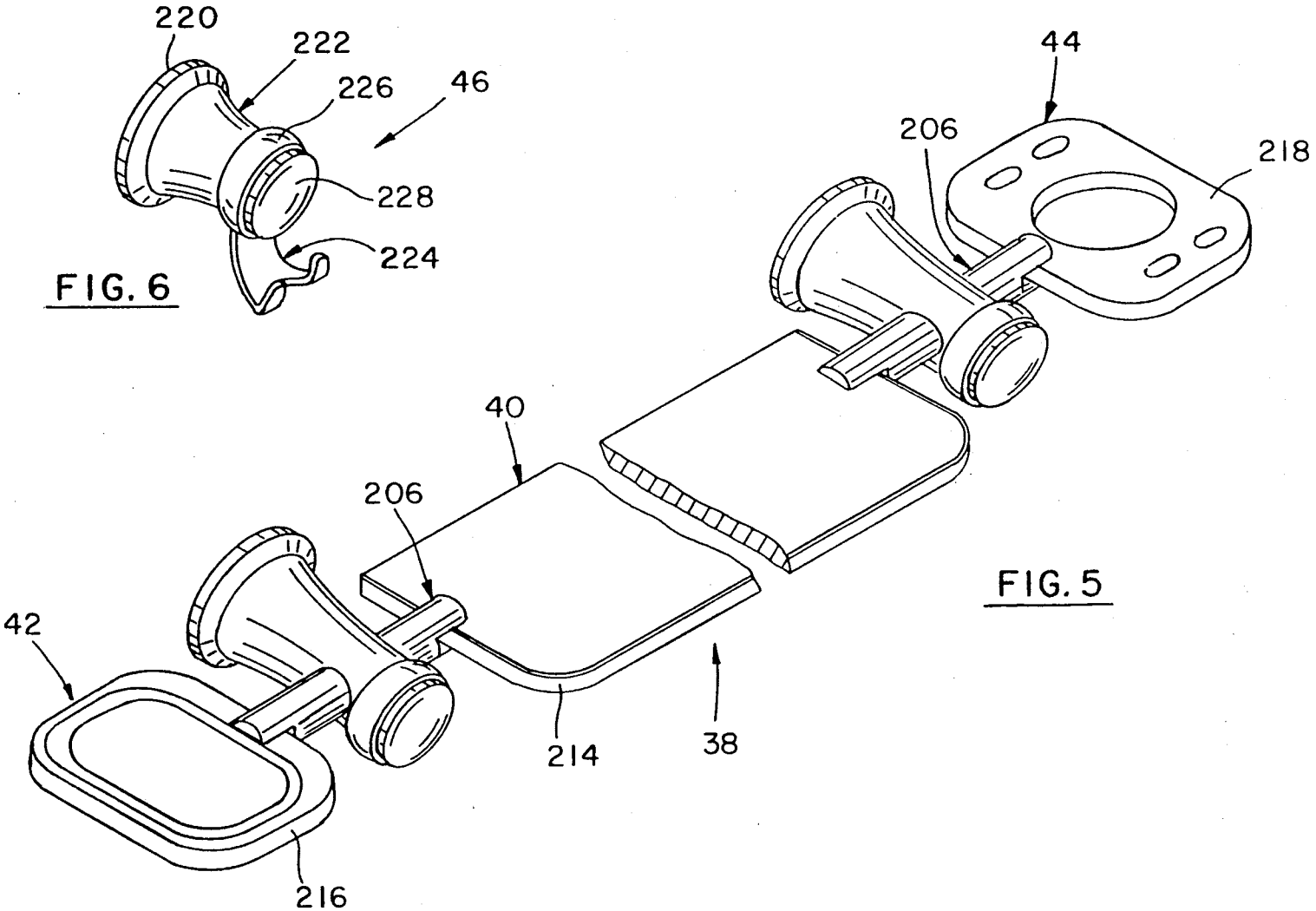
FIG. 5 is perspective view of a shelf with a soap dish on one side and a tumbler/toothbrush holder on the other side all embodying certain principles of the invention.
FIG. 6 is a perspective view of the robe hook embodying certain principles of the invention.

As illustrated in FIG. 5, shelf assembly 38 includes shelf 40, soap dish 42 and tumbler/toothbrush holder 44 all of which function in the same manner as shelf 32, soap dish 34 and holder 36, respectively. Assembly 38 also includes a pair of spaced supports 194 and 196 and a pair of inserts 198 and 200.

Figure 13:
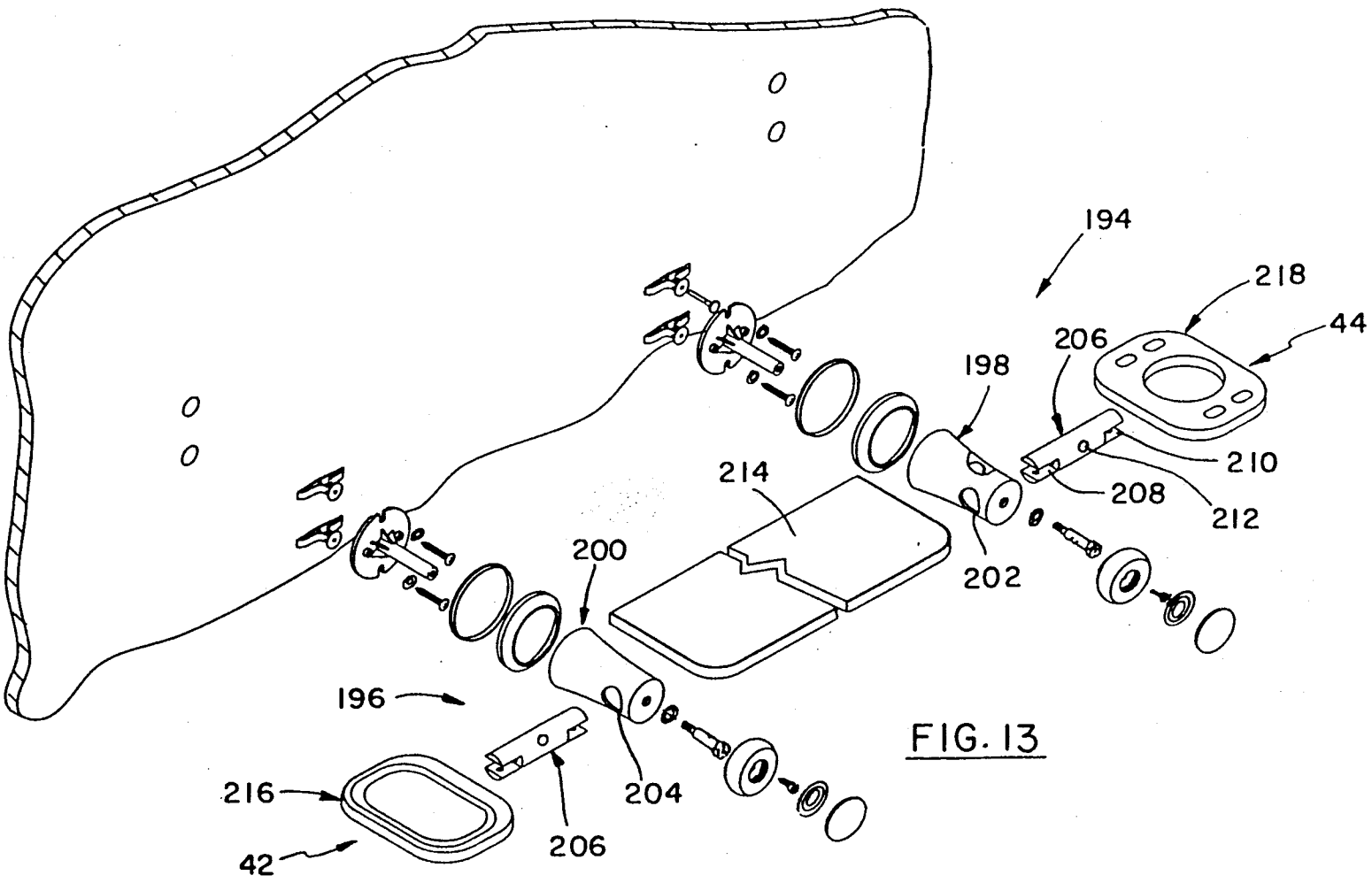
FIG. 13 is a perspective exploded view of a portion of a mounting assembly for the shelf, soap dish and tumbler/toothbrush holder of FIG. 5 and embodying certain principles of the invention.

Referring to FIG. 13, spaced supports 194 and 196 are similar to supports 148 and 150 (FIG. 11). Therefore, only those portions of supports 194 and 196 which differ from supports 148 and 150 will be described. Supports 194 and 196 include sleeves 198 and 200 which are formed with aligned holes 202 and 204 in opposed side walls, hole 202 being identical in shape and location to hole 106 of sleeve 64 (FIG. 10). Supports 194 and 196 also include inserts 206 which are similar, but not identical, in structure and function to insert 154 (FIG. 11) Insert 206 is formed with a first slot 208 at one end thereof and a second slot 210 at the other end thereof. A transaxis through-hole 212 is formed through insert 206 at a central location. Threaded set screw holes are formed in insert 206 in the slots 208 and 210 in the same manner that threaded holes 162 and 164 (FIG. 11) are formed in insert 154.

In assembly, sleeves 198 and 200 are positioned so that hole 202 of sleeve 198 faces hole 204 of sleeve 200 and the remaining holes 202 and 204 of the sleeves face outwardly thereof. One insert 206 is positioned through holes 202 and 204 of sleeve 198 so that slot 208 faces toward sleeve 200, slot 210 faces outwardly from sleeve 198 and hole 212 is aligned axially with the sleeve to eventually receive a stem such as, for example, stem 120 (FIG. 11). Another insert is assembled in similar fashion with insert 200.

An accessory element such as shelf element 214 of shelf 40 is assembled within the facing slots of inserts 206 of sleeves 198 and 200 in the same manner that shelf element 152 (FIG. 11) was assembled, including the levelling adjustment. Thereafter, another accessory element such as a soap dish element 216 of soap dish 42 is assembled in the outboard slots of one of the inserts 206 and still another accessory element such as a support tray 218 of tumbler/toothbrush holder 44 is assembled in the outboard slot of the other insert 206 in the same manner that soap dish element 174 and support tray 186 (FIG. 12) are assembled. Note that, since the levelling operation was accomplished when assembling shelf element 214, there is no need to perform any further levelling operations when assembling soap dish element 216 and support tray 218.

Referring to FIG. 6, robe hook 46 includes a flange 220, a sleeve or hub 222, an accessory element such as a hook element 224, a decorator ring 226 and an end-cover button 228 all of which are assembled in a manner similar to the other assemblies of FIGS. through 5.

Figure 14:
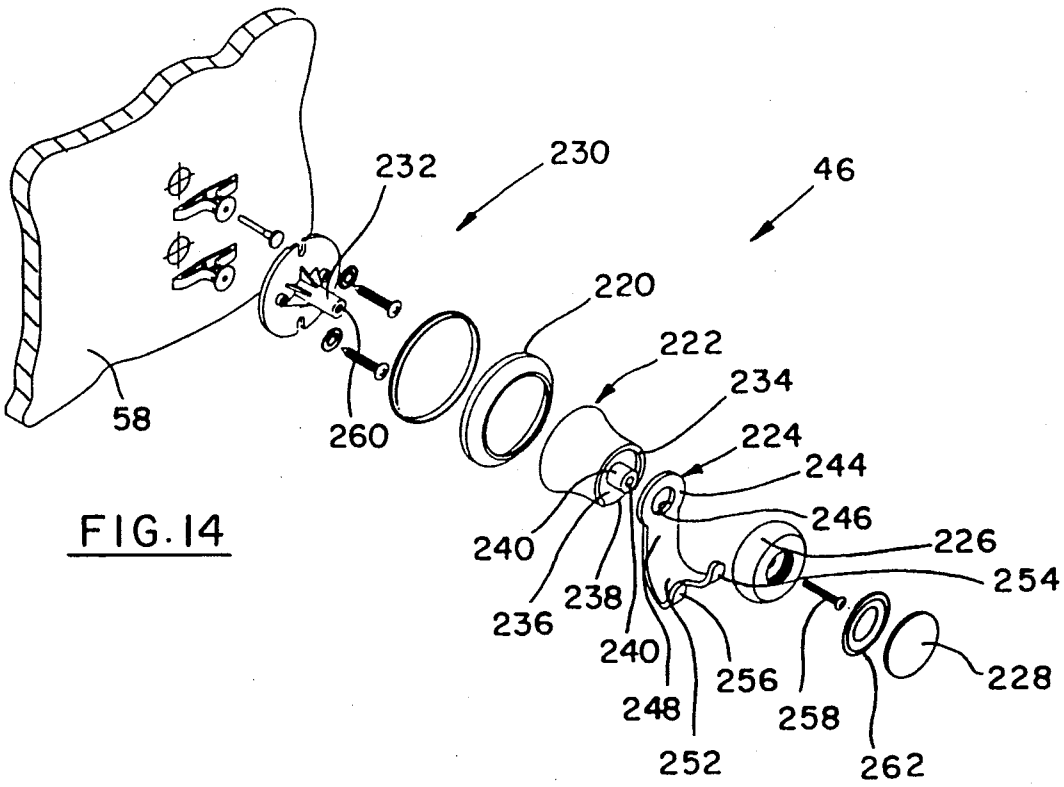
FIG. 14 is a perspective exploded view of a portion of a mounting assembly for the robe hook of FIG. 6 and embodying certain principles of the invention.

As illustrated in FIG. 14, robe hook 46 also includes a mounting assembly 230 which is identical to the above-described mounting assemblies 70 except that a post 232 of the assembly is of shorter length than the corresponding post 78 (FIG. 10). Also, sleeve 222 is of shorter axial length than, for example, sleeves 64 (FIG. 10). Further, sleeve 232 is not formed with any holes in the side surfaces thereof but is formed with a noncontinuous ridge 234 about the perimeter edge of a covered end 236 of the sleeve. A gap 238 is formed by a discontinuity in ridge 234 while a boss 240 extends axially outwardly from covered end 236 and is formed with an axial hole 242 which extends through the boss and the covered end. Hook element 224 is formed with an eyelet-type upper end 244 having a hole 246 formed therein. An intermediate web 248 links end 244 to a lower end 250 which has a portion 252 angled outwardly and two spaced end tines 254 and 256 which serve to support a robe (not shown) hung thereon.

In describing the assembly of the components of robe hook 46, only those aspects thereof which differ from the previously described assembly procedures will be described. After sleeve 222 has been positioned over wall-mounted post 232, hole 246 of hook element 224 is positioned over boss 240 and web 248 is located within gap 238 so that the inward surface of end 244 rests against the surface of covered end 236 of sleeve 222. Thus, the ridge 234, covered end 236 and gap 238 form a receptacle opening for receiving portions of hook element 224. Decorator ring 226 is then faced against the outward surfaces of hook element end 244 and ridge 234. A screw 258 is positioned axially through ring 226, boss 240 and is threadedly secured into an axially threaded aperture 260 of post 232. Button 228 and washer 262 are then assembled in the manner previously described to complete assembly of robe hook 46.

As illustrated in FIG. 7, towel ring 48 includes a similar arrangement of components as previously described and particularly includes a flange 264, a short sleeve 266, a decorator ring 268, an end-cover button 270 and an accessory element such as a towel-supporting ring 272 mounted in the sleeve.

Figure 15:
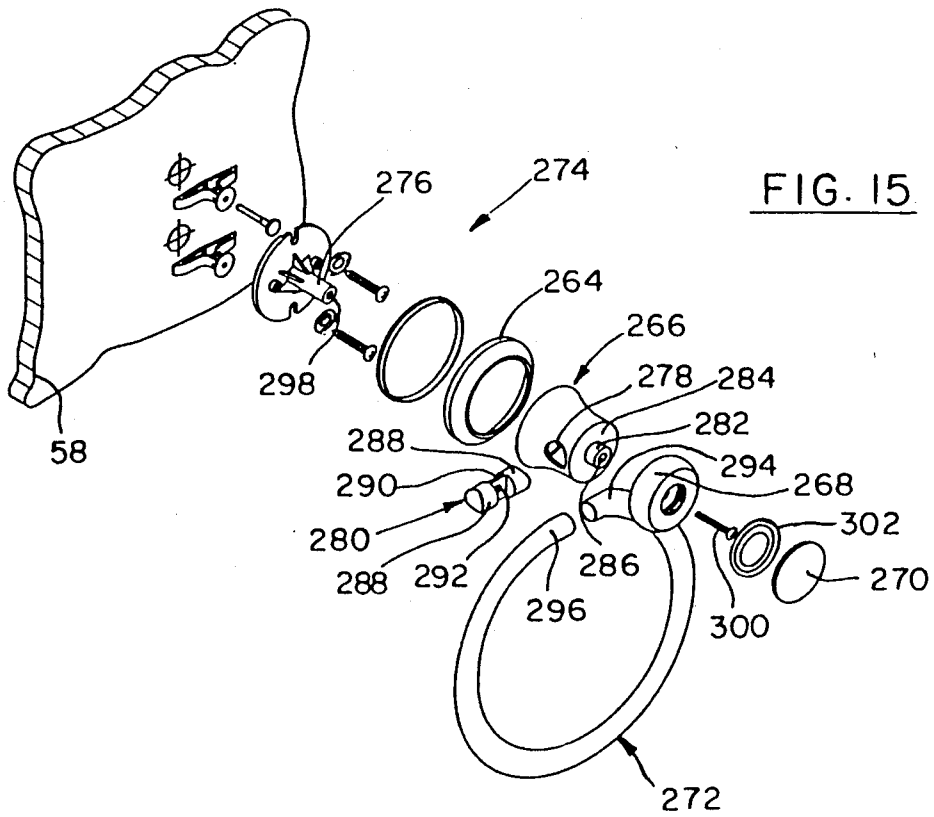
FIG. 15 is a perspective exploded view of a portion of a mounting assembly for the towel ring of FIG. 7 and embodying certain principles of the invention.

Referring to FIG. 15, a mounting assembly 274 of towel ring 48 includes a short post 276. Short sleeve 266 is formed with spaced aligned holes 278 (one shown) in opposite side walls thereof to receive an insert 280 and is also formed with an axial boss 282 extending from a covered end 284 of the sleeve. A hole 286 is formed axially through boss 282 and end 284. Insert 280 is also formed with a pair of receptacle openings such as a pair of pockets 288 at opposite ends thereof which are linked by a web 290. A hole 292 is formed through web 290. Ring 272 is generally circular in shape and is formed with two spaced, facing end portions 294 and 296 each of which are straight and in the same axial plane.

In describing the assembly of the components of towel ring 48, only those aspects thereof which differ from previously described assembly procedures will be described. Insert 280 is initially placed through holes 278 of sleeve 266 and insert hole 292 is aligned with sleeve hole 286. Sleeve 266 is then positioned over post 276 in the manner previously described taking care to insure that insert hole 292 and sleeve hold 286 are aligned with an axial threaded aperture 298 formed in post 276. Decorator ring 268 is positioned over boss 282 and against covered end 284. A screw 300 is inserted through ring 268, boss 282, end 284 and is threadedly inserted into threaded aperture 298 but not tightened. Ring 272 is flexed to separate spaced ends 294 and 296 thereof which are then positioned in alignment with pockets 288 of assembled insert 280. Ring 272 is released so that the spread-apart ends 294 and 296 are inserted into pockets 288 of insert 280. The assembled ring is then examined to insure that it is level. Thereafter, screw 300 is tightened and a washer 302 and button 270 are assembled as described above to complete assembly of the components of towel ring 48.

As illustrated in FIG. 8, soap dish stand 50 includes an arrangement of components similar to soap dish 34 (FIG. 3) and particularly includes a support 303 having a pedestal or base 304, a flange 306, a sleeve 308, a decorator ring 310, and an end-cover button 312.

Figure 16:
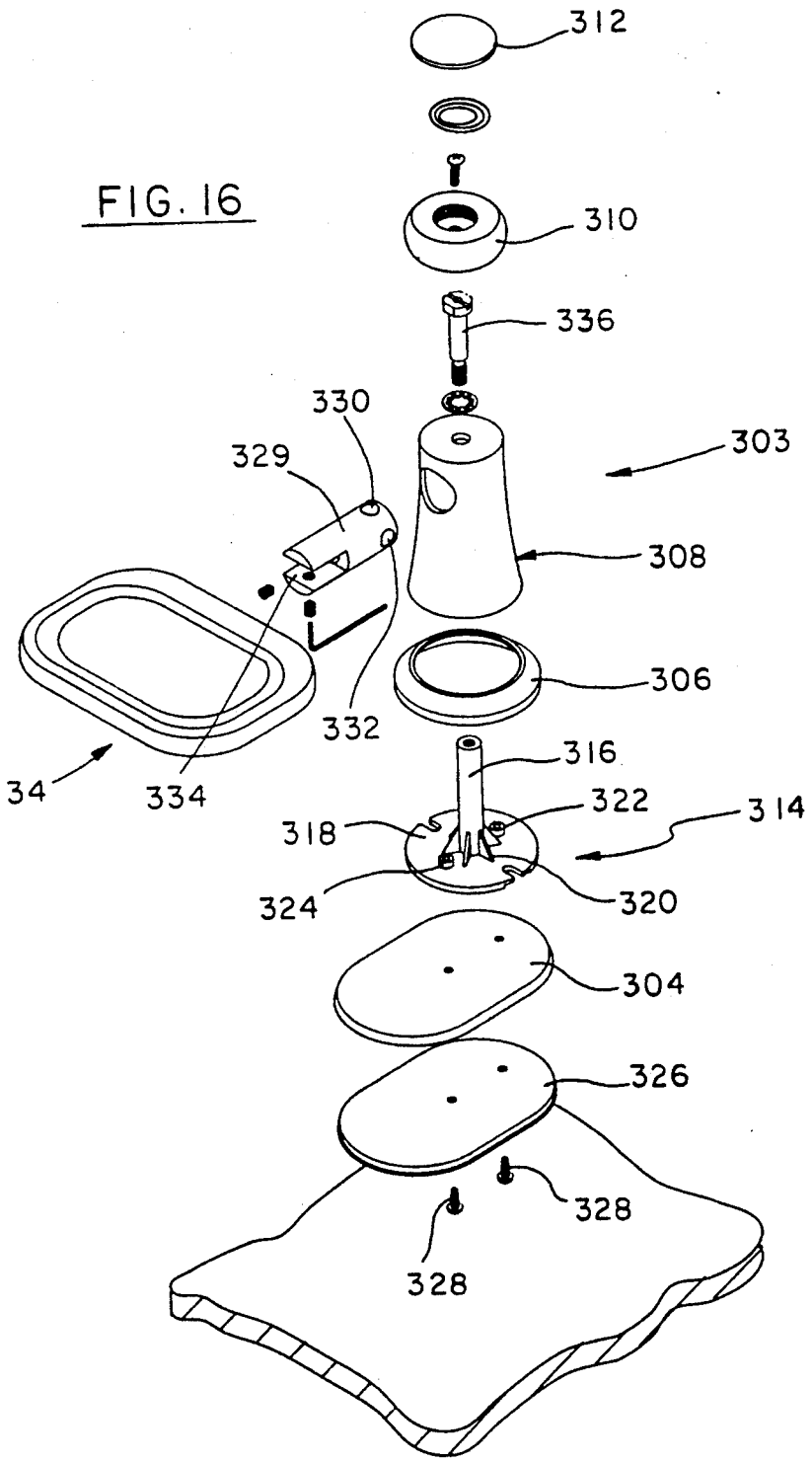
FIG. 16 is a perspective exploded view of a portion of a mounting assembly for the soap dish stand of FIG. 8 and embodying certain principles of the invention.

Referring to FIG. 16, a mounting assembly 314 includes a long post 316 and is attached to a base plate 318 and supported thereon by a plurality of braces 320. A pair of bosses 322 and 324 extend upwardly from base plate 318 on diametrically opposite sides of post 316. A threaded hole is formed through each of the bosses 322 and 324 and also extends through base plate 318. A base pad or gasket 326 of soft non-marring material is placed in an underside recess (not shown) of base 304 and base plate 318 is positioned on top of the base 304 so that the threaded holes of bosses 322 and 324 align with holes in the base and base pad 326. A pair of screws 328 are then inserted from the underside of base pad 326, through the holes in the base pad and base 304 and threadedly inserted into the threaded holes of bosses 322 and 324 to secure this assembly together The remaining components of soap dish stand 50 are assembled in the same manner as the assembly of common components in soap dish 34 (FIG. 12). It is noted that, as illustrated in FIG. 16, an insert 329, which is identical to inserts 154 (FIG. 11) and 172 (FIG. 12), is formed with two sets of holes 330 and 332 which are formed through the end of the insert closest to sleeve 308. The axes of holes 330 and 332 are perpendicular to each other as illustrated in FIG. 16 and are especially located with respect to a receptacle opening such as a slot 334 so that, when the slot is oriented as shown in FIG. 16, hole 330 is positioned to receive a stem 336 and, when the slot is positioned as shown in FIGS. 11, 12 and 13, hole 332 is positioned to receive the stem. This provides universality in the manufacture of an insert which is common to the inserts of the assemblies illustrated in FIGS. 11, 12, 13 and 16.

As shown in FIG. 9, toilet paper holder 52 includes a pair of spaced supports 338 and 340 which are mounted to wall 58 and extend therefrom in the same manner as supports 54 and 56 (FIG. 1) of towel bar 30. An accessory element such as roller dispenser 342 is attached at opposite ends thereof to supports 338 and 340 and supports a roll of toilet paper (not shown) for dispensing thereof in the normal manner.

Figure 17:
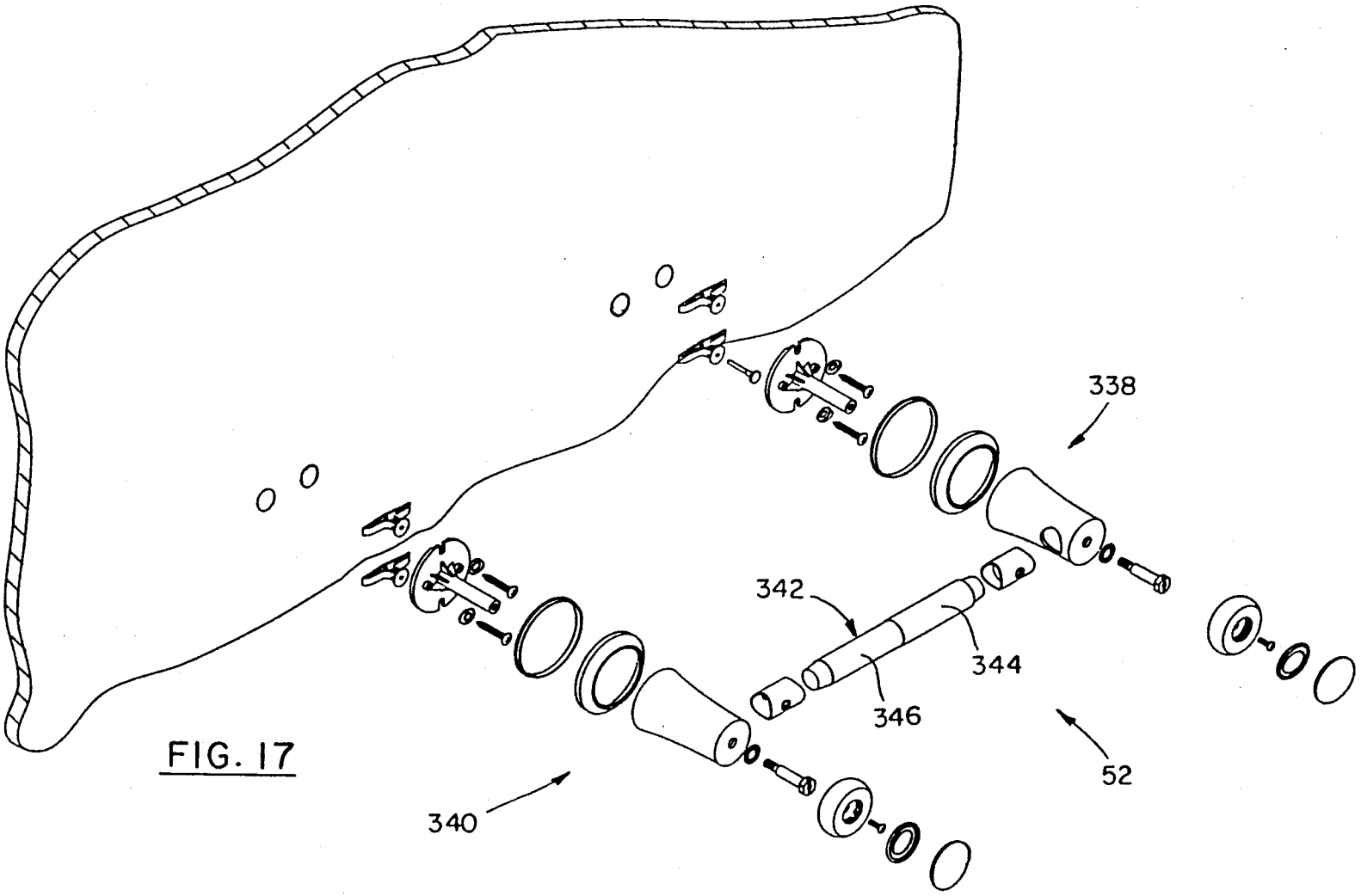
FIG. 17 is a perspective exploded view of a portion of a mounting assembly for the toilet paper holder of FIG. 9 and embodying certain principles of the invention.

Referring to FIG. 17, dispenser 342 is formed by two sleeve-like elements 344 and 346, each of such a diameter that element 346 is slidable into element 344. A spring (not shown) is contained within element 344 and normally urges element 346 outwardly therefrom is shown but is precluded from complete separation by structure (not shown) formed on both elements and concealed within element 344. Tip ends 348 and 350 of dispenser 342 are tapered to facilitate easy entry of the ends into receiving pockets of supports 338 and 340. The remaining components of supports 338 and 340 are assembled in the same manner as the assembly of components of supports 54 and 56 (FIG. 10).

The above-described embodiments, of course, are not to be construed as limiting the breadth of the present invention. Modifications, and other alternative constructions, will be apparent which are within the spirit and scope of the invention as defined in the appended claims.

What is claimed is:

1. A mounting assembly for an accessory, which comprises:
   - means for supporting an accessory element in position for utility;
   - means for facilitating attachment of the accessory element to the supporting means;
   - enclosing means formed as an integral one-piece unit with the supporting means for receiving and enclosing therein at least an enclosed portion of the facilitating means;
   - mounting means for locating the supporting means and the accessory element relative to an external support;
   - the supporting means formed with an aperture which is aligned with an aperture formed in the enclosed portion of the facilitating means; and
   - means positioned through the aligned apertures of the supporting means and the enclosed portion of the facilitating means and attached to the mounting means for securing together the supporting means and the facilitating means independently of the accessory element so that the supporting means and the facilitating means are inseparable without dismantling the securing means.

2. The mounting assembly as set forth in claim 1 wherein the mounting means includes:
   - a base mountable on, and having a first face which interfaces with, the external support;
   - a post attached at one end thereof to the base and extending axially from a second face of the base on a side thereof opposite the first face.

3. The mounting assembly as set forth in claim 2 wherein the supporting means includes a hub which is mounted on the post.

4. The mounting assembly as set forth in claim 3 wherein the facilitating means includes an insert formed with a receptacle opening where the insert is supported on the hub and the accessory element is located at least in part in the receptacle opening.

5. The mounting assembly of claim 4 wherein the receptacle opening is a cup-like opening formed in the insert.

6. The mounting assembly of claim 4 wherein the receptacle opening is a slot formed in the insert.

7. The mounting assembly as set forth in claim 4 wherein an end of the post opposite the one end thereof is formed with a threaded aperture; the hub is formed with a through-hole aligned with the threaded aperture; the hub is formed with a hole in a side wall thereof; the insert is insertable into the hole of the hub and is formed with a lateral through-hole which is alignable with the threaded aperture of the post and with the hub through-hole; and which further comprises a stem with a threaded end positioned through the hub through-hole, the lateral hole of the insert and is threadedly secured within the threaded aperture of the post.

8. The mounting assembly as set forth in claim 7 wherein the stem is formed with the threads at one end, an intermediate unthreaded shank located within the lateral hole of the insert and a head at an end opposite the one end larger than the hub through-hole.

9. The mounting assembly as set forth in claim 1 wherein the supporting means includes a pair of spaced hubs with the accessory element supported at least at opposite ends thereof by the spaced hubs.

10. The mounting assembly as set forth in claim 1 wherein the accessory element is supported by the supporting means in cantilever fashion.

11. The mounting assembly as set forth in claim 3 wherein the hub is formed with a pair of spaced holes in opposite side walls thereof.

12. The mounting assembly as set forth in claim 11 wherein said facilitating means comprises an insert having receptacle openings at opposite ends thereof and located within a space between the spaced holes of the hub with the receptacle openings facing outwardly from the side walls for receiving at least portions of at least one accessory element.

13. The mounting assembly as set forth in claim 9 wherein the accessory element supported between the hubs is a first accessory element and wherein one of the pair of hubs supports a second accessory element extending from one hub in a direction away from the first accessory element and the other of the pair of hubs supports a third accessory element extending from the other hub in a direction away from the first and second elements.

14. The mounting assembly as set forth in claim 3 which further comprises:

a pedestal having a first surface supportable on the external support;

the base attached to a second surface of the pedestal;

the hub mounted on the post; and the accessory element supported on the hub.

15. An accessory, which comprises:

an accessory element;

means for supporting the accessory element in position for utility;

means for facilitating attachment of the accessory element to the supporting means;

enclosing means formed as an integral one-piece unit with the supporting means for receiving and enclosing therein at least an enclosed portion of the facilitating means;

mounting means for locating the supporting means and the accessory element relative to an external support;

the supporting means formed with an aperture which is aligned with an aperture formed in the enclosed portion of the facilitating means; and means positioned through the aligned apertures of the supporting means and the enclosed portion of the facilitating means and attached to the mounting means for securing together the supporting means and the facilitating means independently of the accessory element so that the supporting means and the facilitating means are inseparable without dismantling the securing means.

16. An accessory as set forth in claim 15, wherein the supporting means includes a pair of spaced supporting assemblies and the accessory element is supported at opposite ends thereof by and between the spaced supporting assemblies.

17. An accessory as set forth in claim 16 wherein the accessory element between the spaced supporting assemblies is a first accessory element, and which further comprises:

a second accessory element supported on and by one of the pair of supporting assemblies, and a third accessory element supported on and by another of the pair of supporting assemblies.

18. An accessory as set forth in claim 15, which further comprises:

pedestal means for attachment to the mounting means whereby the pedestal means is mountable on the external support to position the accessory element for utilization relative to the external support.

19. An accessory as set forth in claim 15, wherein the accessory element is attached to opposite sides of the supporting means.

20. An accessory as set forth in claim 15 wherein the accessory element is supported in cantilever fashion by the supporting means.

* * * * *